US008863438B1

(12) United States Patent
Seitz et al.

(10) Patent No.: US 8,863,438 B1
(45) Date of Patent: Oct. 21, 2014

(54) APPARATUS AND METHOD OF CONSTRUCTION OF AN OVERHEAD DOOR

(71) Applicant: Floating Door, LLC, Ketchum, OK (US)

(72) Inventors: Pete Seitz, Ketchum, OK (US); Jerry Hopper, Ketchum, OK (US)

(73) Assignee: Floating Door, LLC, Ketchum, OK (US)

( * ) Notice: Subject to any disclaimer, the term of this patent is extended or adjusted under 35 U.S.C. 154(b) by 0 days.

(21) Appl. No.: 14/066,003

(22) Filed: Oct. 29, 2013

(51) Int. Cl.
*E05D 15/38* (2006.01)

(52) U.S. Cl.
USPC ..... 49/197; 52/655.1; 52/653.1; 52/653.2

(58) Field of Classification Search
USPC ..... 49/197, 198, 199; 160/201, 236; 52/655.1, 653.1, 653.2, 664, 665, 241, 52/317, 481.1
See application file for complete search history.

(56) References Cited

U.S. PATENT DOCUMENTS

| | | | | | |
|---|---|---|---|---|---|
| 1,867,226 | A * | 7/1932 | Martin | 403/262 |
| 3,341,160 | A * | 9/1967 | Jones, III | 248/165 |
| 3,593,477 | A * | 7/1971 | Briggs | 52/253 |
| 4,054,392 | A * | 10/1977 | Oppenheim | 403/175 |
| 4,093,167 | A * | 6/1978 | Rooklyn | 248/188 |
| 4,235,559 | A * | 11/1980 | Rooklyn | 403/262 |
| 4,593,514 | A * | 6/1986 | Smith | 52/653.1 |
| 4,884,831 | A * | 12/1989 | Emon | 292/38 |
| 5,713,176 | A * | 2/1998 | Hunt | 52/847 |
| 6,092,347 | A * | 7/2000 | Hou | 52/648.1 |
| 6,219,989 | B1 * | 4/2001 | Tumura | 52/838 |
| 6,279,288 | B1 * | 8/2001 | Keil | 52/653.2 |
| 6,523,322 | B1 * | 2/2003 | Michalski et al. | 52/745.05 |
| 6,694,700 | B1 * | 2/2004 | Mackett | 52/764 |
| 7,637,076 | B2 * | 12/2009 | Vaughn | 52/838 |
| 7,762,038 | B2 * | 7/2010 | Ceba et al. | 52/653.1 |
| 8,028,494 | B2 * | 10/2011 | Denn et al. | 52/848 |
| 8,387,321 | B2 * | 3/2013 | diGirolamo et al. | 52/242 |
| 8,468,775 | B2 * | 6/2013 | Vaughn | 52/843 |
| 2004/0244330 | A1 * | 12/2004 | Takeuchi et al. | 52/729.1 |
| 2007/0044417 | A1 * | 3/2007 | Surowiecki | 52/653.1 |
| 2007/0209314 | A1 * | 9/2007 | Vaughn | 52/720.1 |
| 2007/0261356 | A1 * | 11/2007 | Vaughn | 52/655.1 |
| 2009/0044480 | A1 * | 2/2009 | Bonds | 52/653.2 |
| 2009/0064611 | A1 * | 3/2009 | Hall et al. | 52/236.9 |
| 2010/0031600 | A1 * | 2/2010 | Nakagawa et al. | 52/653.1 |
| 2010/0077664 | A1 * | 4/2010 | Stensland | 49/197 |
| 2010/0126103 | A1 * | 5/2010 | diGirolamo et al. | 52/655.1 |
| 2011/0088348 | A1 * | 4/2011 | Rahimzadeh et al. | 52/649.2 |
| 2011/0289878 | A1 * | 12/2011 | Morey | 52/653.2 |
| 2011/0296786 | A1 * | 12/2011 | Rice | 52/653.1 |
| 2012/0167518 | A1 * | 7/2012 | Hawkins et al. | 52/655.1 |
| 2012/0317919 | A1 * | 12/2012 | Rahimzadeh et al. | 52/655.1 |
| 2014/0000207 | A1 * | 1/2014 | Rahimzadeh et al. | 52/650.3 |

* cited by examiner

*Primary Examiner* — Jerry Redman
(74) *Attorney, Agent, or Firm* — Head, Johnson & Kachigian, P.C.

(57) ABSTRACT

An overhead door frame apparatus having a plurality of elongated structural C-channel members. At least one of the members has a tube secured within and perpendicular to the first member and having a flat plate attached to an outside of the tube. At least an adjacent C-channel member of the plurality of members having a closed end. At least one fastener passes through the flat plate and through the tube of the first member and through the adjacent member.

11 Claims, 7 Drawing Sheets

APPARATUS AND METHOD OF CONSTRUCTION OF AN OVERHEAD DOOR

BACKGROUND OF THE INVENTION

1. Field of the Invention

The present invention is directed to an apparatus and method of construction of an overhead door. In particular, the present invention is directed to an apparatus and method wherein prefabricated components can be shipped to a work site for final assembly of an overhead door.

2. Related Art

Large overhead doors are utilized in a variety of applications, such as in industrial plants and for airplane hangars. The overhead doors are typically fabricated from a metal frame to form a single piece which is covered with a metal or other face material. The overhead door may be opened and closed by an hydraulic cylinder or cylinders.

Often, in the past, these doors have been manufactured and then shipped to a desired location for installation with a building. The fabricated doors may be extremely large and are difficult to transport over the highway. Additionally, many of the large overhead doors are extremely heavy and difficult to move.

An alternative to shipping an overhead door from a manufacturing facility is to fabricate the overhead door on-site. The metal overhead door normally requires welding and other fabrication procedures.

Accordingly, it would be desirable to develop an apparatus and a method for construction and assembly of an overhead door from prefabricated components.

It would also be desirable to develop an apparatus and a method for construction of an overhead door onsite without any welding required.

It would also be desirable to develop an apparatus and a method for construction of an overhead door from prefabricated components that could be adapted to nearly any size or configuration.

It would also be desirable to develop an apparatus and a method for construction of an overhead door from prefabricated components wherein the prefabricated components are assembled from readily available metal parts.

SUMMARY OF THE INVENTION

The present invention is directed to an overhead door frame apparatus and a method of construction of the overhead door. The overhead door frame apparatus may be shipped to a building or work site in its component form and assembled on-site. The apparatus is fabricated from readily available metal C-channel members.

In one connection joint, a first one of the C-channel members runs horizontally along a portion or all of the apparatus. Each C-channel member includes an elongated channel having a base, two extending legs with each leg extending vertically from the base, and a radial lip extending from the opposed end of each leg. A tube having a square cross-section resides within and is welded to the first C-channel member perpendicular to the C-channel member. A spacer plate is welded or otherwise secured to an outside of the tube. A pair of holes is drilled through the spacer plate and through the tube. A pair of threaded nuts is welded inside of the tube aligned with the holes through the tube and through the spacer plate.

At least one adjacent C-channel member is arranged perpendicular to the first C-channel member. A flat end plate is welded or otherwise secured to an open end of the adjacent C-channel member.

Threaded bolts are inserted through the end plate of the adjacent C-channel member, through the spacer plate and through the tube of the first C-channel member and into the nuts where they are threadably received.

In order to assemble or construct an overhead door frame apparatus, a plurality of first C-channel members and a plurality of said adjacent C-channel members are shipped to a work site where they are connected with fasteners to form the overhead door frame apparatus.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
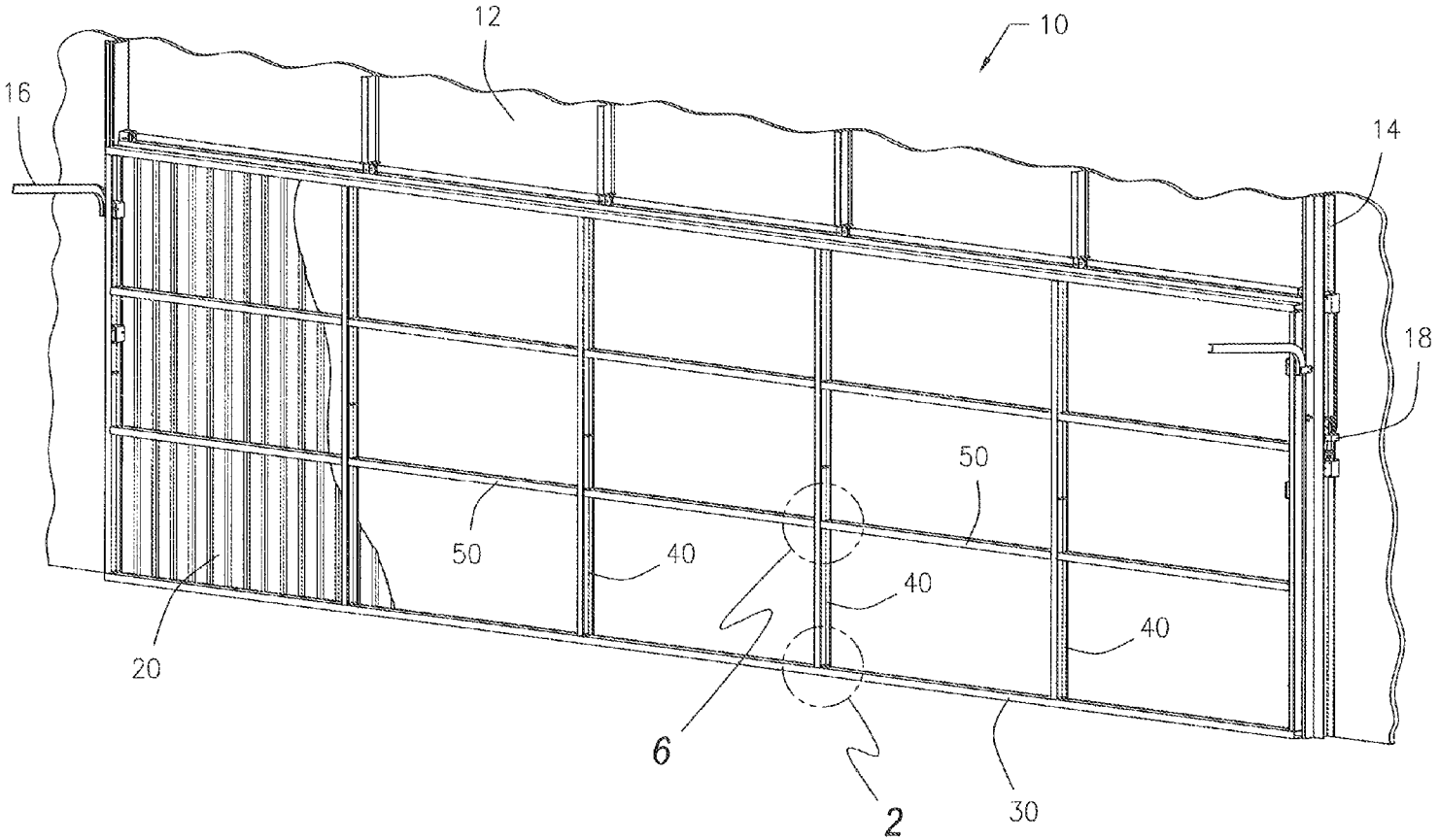
FIG. 1 illustrates a perspective view of an overhead door frame apparatus constructed in accordance with the present invention shown installed in an opening in a building.

Referring to the drawings in detail, FIG. 1 illustrates a perspective view of an overhead door frame apparatus 10 constructed in accordance with the present invention. The apparatus is shown installed in an opening in a building 12 having a plurality of structural beams 14. The FIG. 1 view is shown from the inside of the building. It will be appreciated that the present invention may be utilized with a wide variety of buildings.

The overhead door frame apparatus 10 is shown in a closed position, however, it may be moved to an open position through use of tracks 16 and a lift mechanism 18. The apparatus 10 may be covered by an external material face 20 (a portion of which is shown in FIG. 1). The outer material face 20 may be chosen to match the exterior of the building 12.

As will be described herein, the overhead door frame apparatus 10 may be shipped to a building site or work site in its component form and then assembled on-site.

Figure 3:
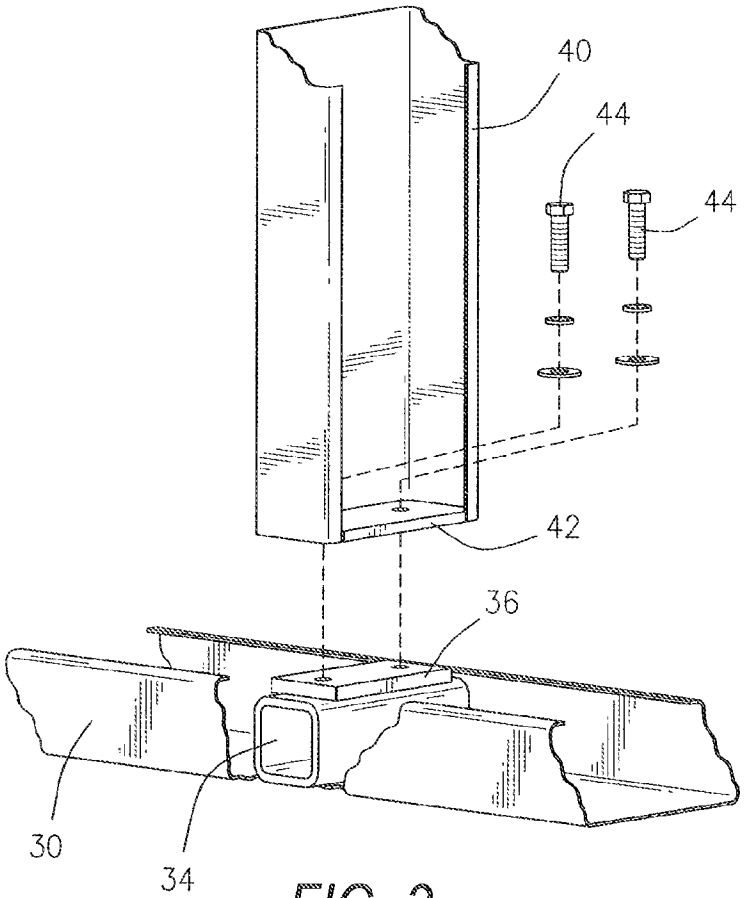
FIG. 3 illustrates an exploded view of the connection joint shown in FIG. 2.
Figure 2:
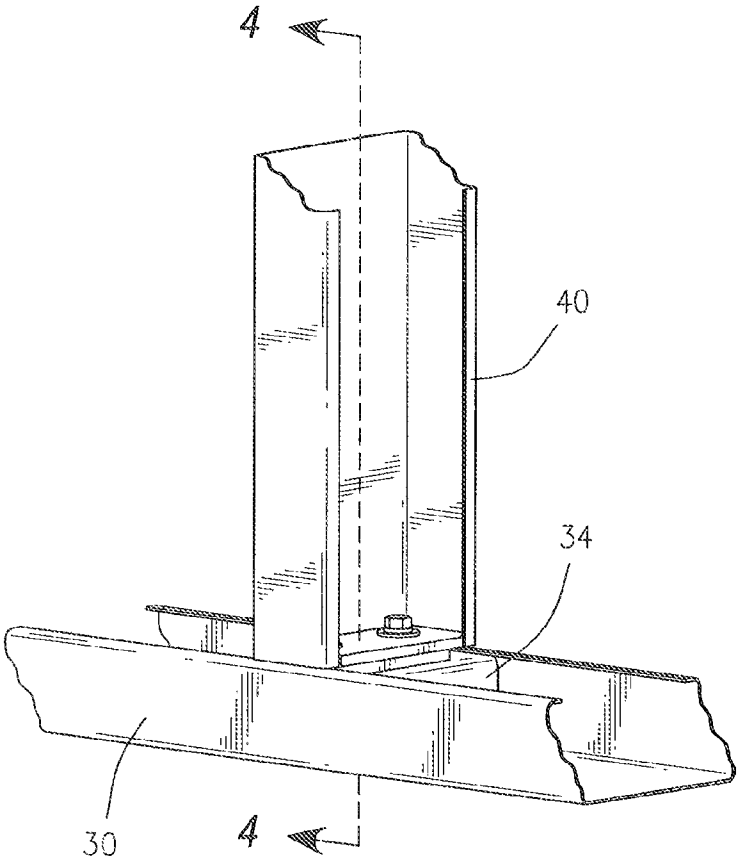
FIG. 2 illustrates one of the connection joints of the overhead door frame apparatus shown in FIG. 1.

FIG. 2 illustrates one of the connection joints connecting the components of the apparatus 10 after assembly, while FIG. 3 illustrates an exploded view of the connection joint. The connection joint is illustrated in the dashed line area marked 2 in FIG. 1.

The apparatus 10 is fabricated from metal C-channel members 30. A first one of the C-channel members 30 runs horizontally on a portion or all of the apparatus 10. Each C-channel member includes an elongated channel having a base, two extending legs with each leg extending vertically from the base, and a radial lip extending from the opposed end of each leg.

A tube 34, having a square cross-section, resides within and is connected to the first C-channel member 30. In a preferred embodiment, the tube is welded to the base of the first C-channel member 30.

A spacer plate 36 is welded or otherwise secured to an outside of the tube 34.

A pair of holes is drilled through the spacer plate 34 and through the tube 34.

A plurality of adjacent C-channel members 40 are arranged perpendicular to the C-channel member 30. A flat metal end plate 42 is welded or otherwise secured to an open end of the adjacent C-channel member 40. A pair of holes is drilled through the end plate 42 of the C-channel member 40 aligned with the holes in the spacer plate 36 and tube 34.

Figure 5:
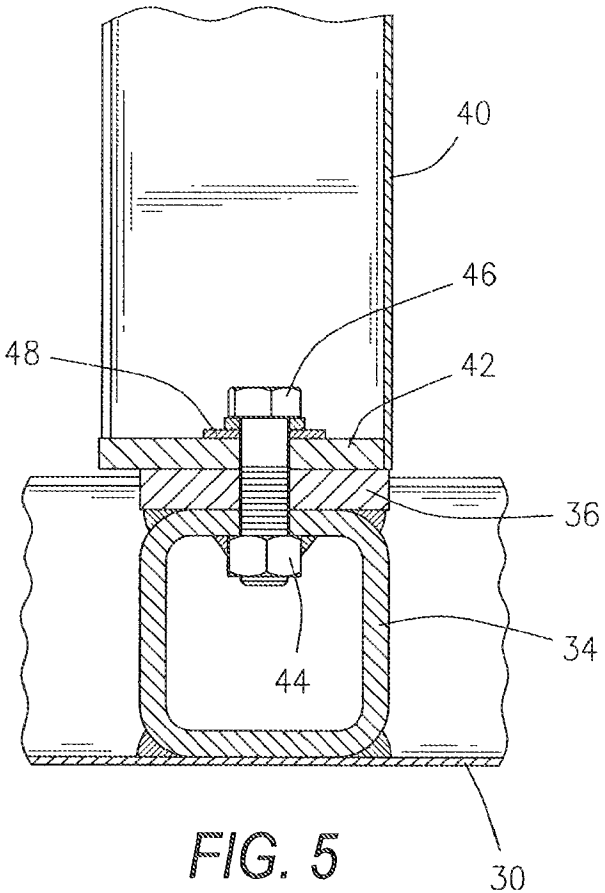
FIG. 5 is the sectional view taken along section line 5-5 of FIG. 4.
Figure 4:
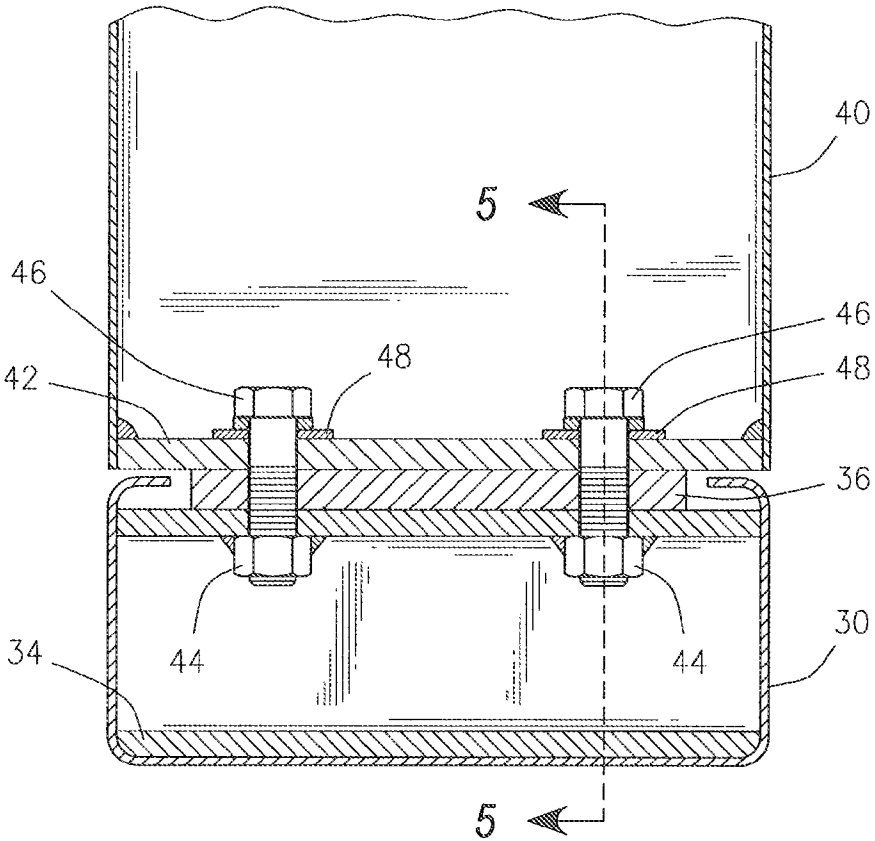
FIG. 4 is the sectional view taken along section line 4-4 of FIG. 2.

FIG. 4 illustrates a sectional view taken along section line 4-4 of FIG. 2, while FIG. 5 illustrates a sectional view taken along section line 5-5 of FIG. 4. A pair of threaded nuts 44 are welded inside of the tube 34 aligned with the holes through the tube 34 and through the spacer plate 36. In order to assemble the connection joint, the openings in the end plate 42 of the C-channel 40 are brought into alignment with the openings in the spacer plate 36 and tube 34. Thereafter, threaded bolts 46 are inserted through the end plate of the C-channel member 40, through the spacer plate 36, through the tube and into the nuts 40 where they are threadably received. Optional washers 48 may be employed.

Another possible connection (not shown) may be made between a C-channel member 40 and another C-channel member 40 each having end plates 42 wherein the C-channel members are in linear alignment. The holes in the end plates are brought into alignment and joined together by bolts 46 and threaded nuts 44.

Figure 6:
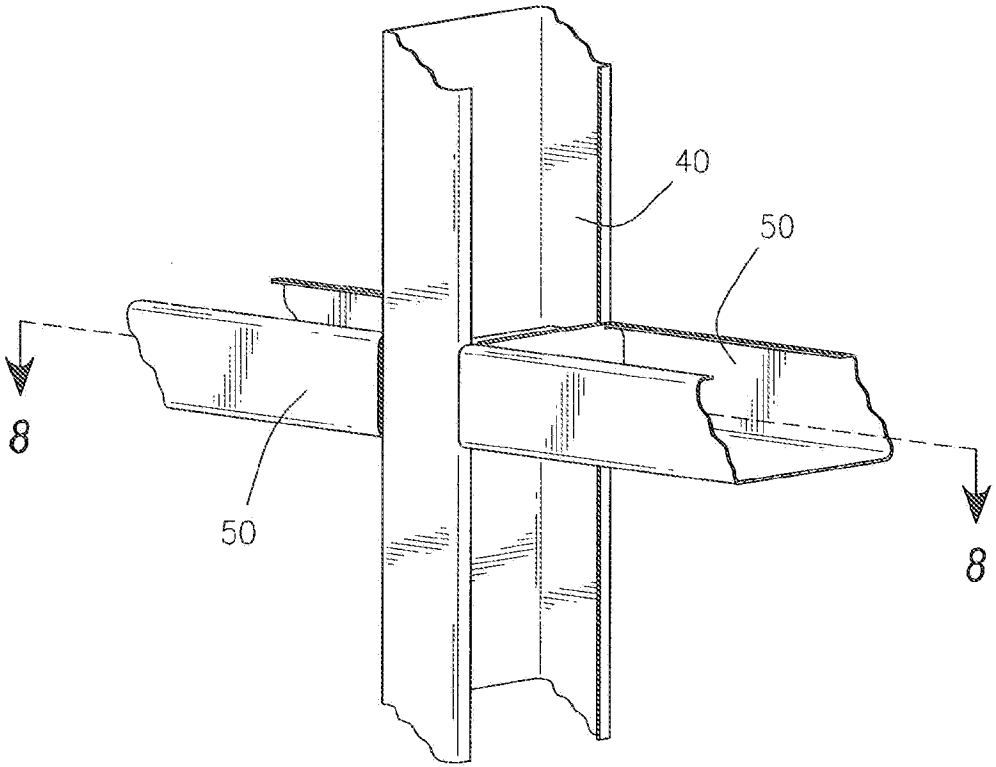
FIG. 6 illustrates one of the connection joints of the overhead door frame apparatus illustrated in FIG. 1.
Figure 7:
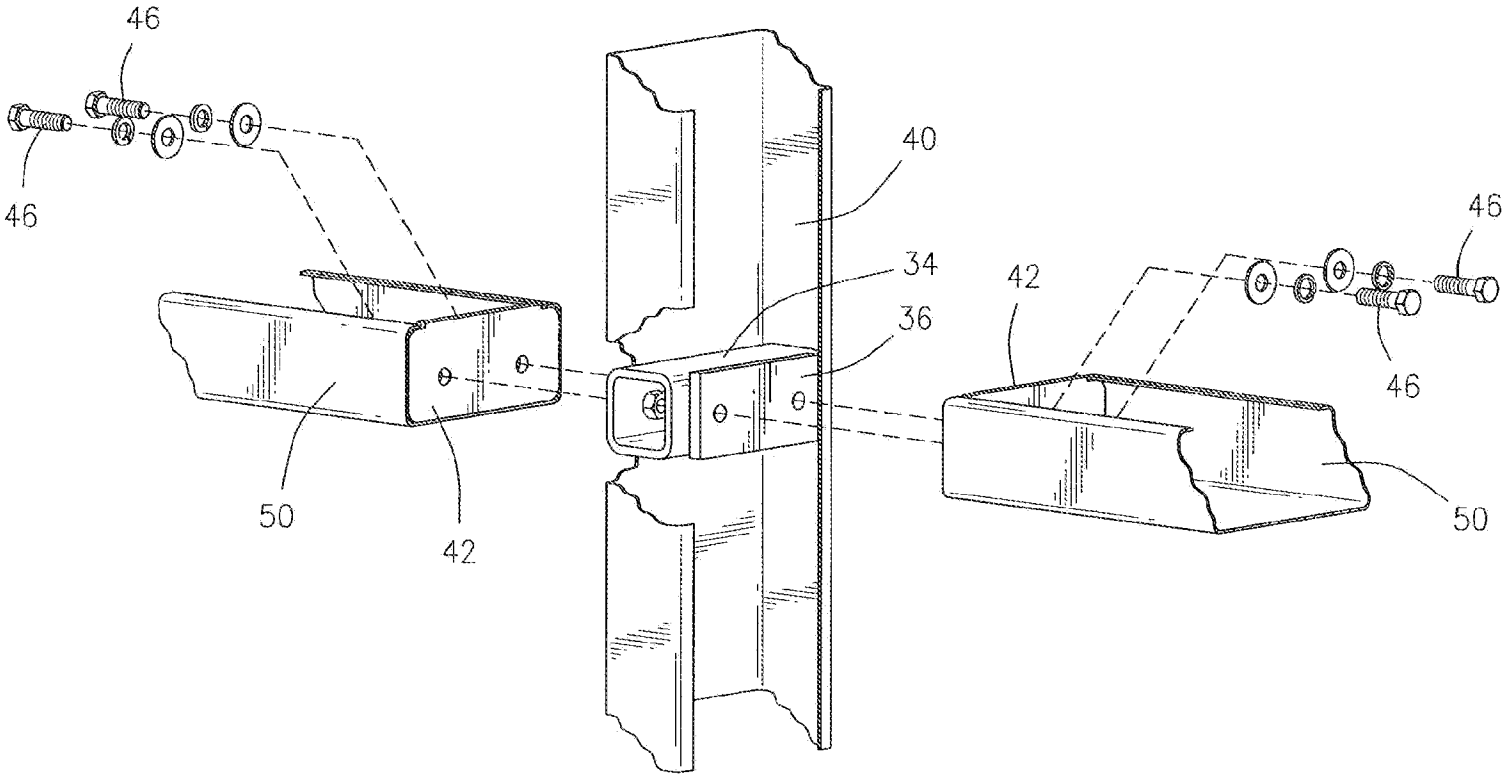
FIG. 7 is an exploded view of the connection joint shown in FIG. 6.
Figure 9:
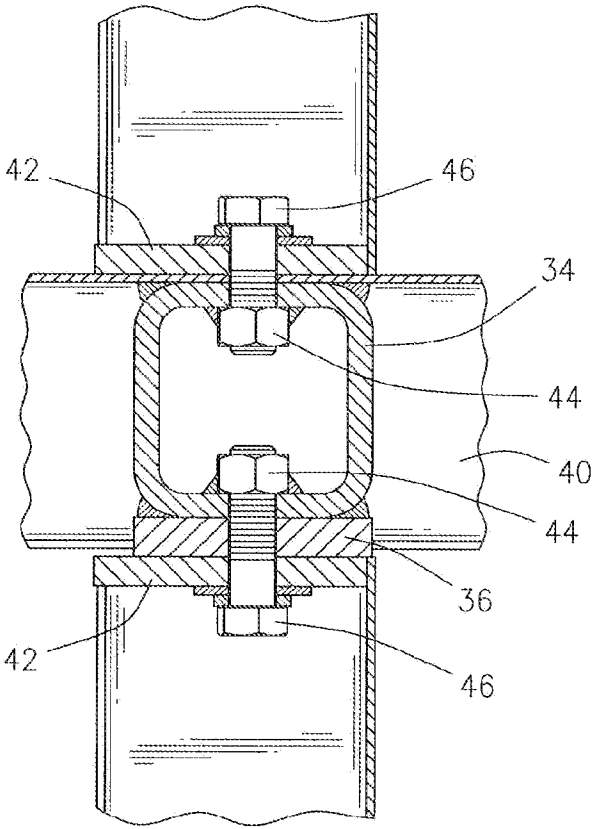
FIG. 9 is a sectional view taken along section line 9-9 of FIG. 8.
Figure 8:
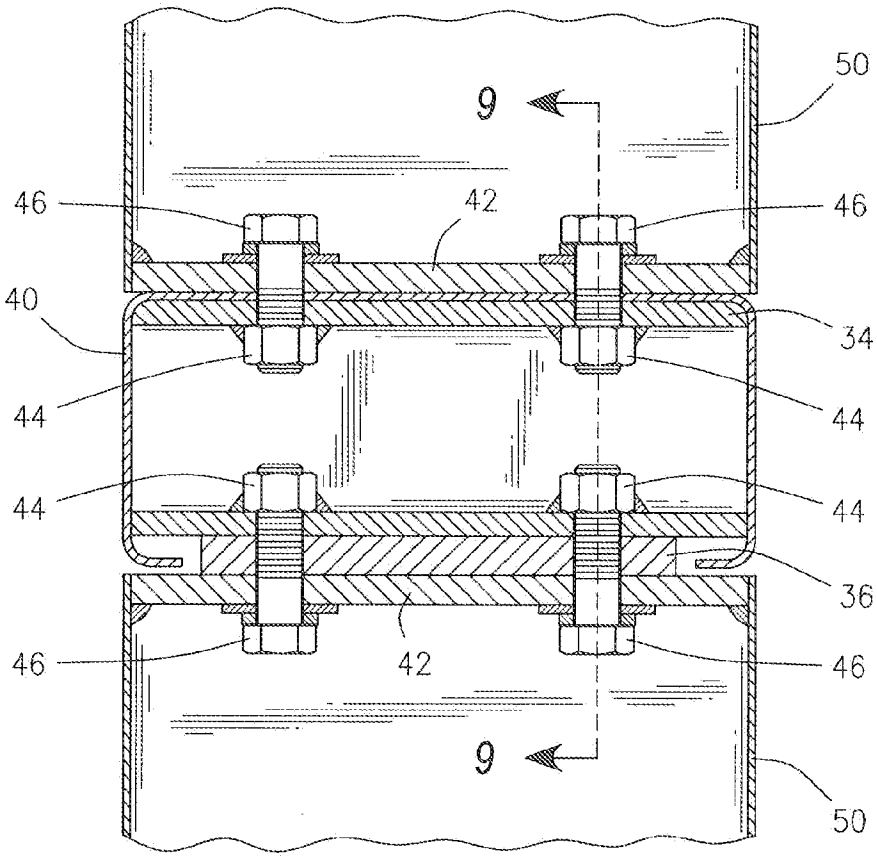
FIG. 8 is a sectional view taken along section line 8-8 of FIG. 6.

Returning to a consideration of FIG. 1, another connection joint of the overhead door frame apparatus 10 may be seen in the dashed line area marked 6 which is shown in FIG. 6. FIG. 7 illustrates an exploded view of the connection joint shown in FIG. 6. A C-channel member 40 extends vertically and joins with two opposed C-channel members 50. As in the previous connection joint, a metal tube visible in FIGS. 7, 8 and 9 is inserted within the C-channel member 40 and welded thereto.

The metal tube 34 has a square cross-section and a length slightly less than the width of the C-channel member 40. A spacer plate 36 is welded or otherwise secured to an outside of the tube 34.

As seen in the exploded view of the connection joint shown in FIG. 7, a pair of holes is drilled through the spacer plate 36 and through the tube 34.

A pair of opposed adjacent C-channel members 50 are arranged perpendicular to the C-channel member 40. A flat metal end plate 42 is welded or otherwise secured to an open end of each of the C-channel members 50. In each of the C-channel members 50, a pair of holes is drilled through each of the end plates 42.

FIG. 8 illustrates a sectional view taken along section line 8-8 of FIG. 6, while FIG. 9 illustrates a sectional view taken along section line 9-9 of FIG. 8. A pair of threaded nuts 44 is welded inside of the tube 34 on each side aligned with the holes through the tube 34. One pair of holes is drilled through the tube 34 and spacer plate 36. Another pair of holes is drilled through the tube 34 and C-channel member 40.

In order to assemble the connection joint, the end plate of each of the C-channel members 50 is brought into alignment with the holes in the C-channel member 40 and the spacer plate 36. Thereafter, threaded bolts 46 secure the C-channel members 50 to the C-channel member 40.

Figure 10:
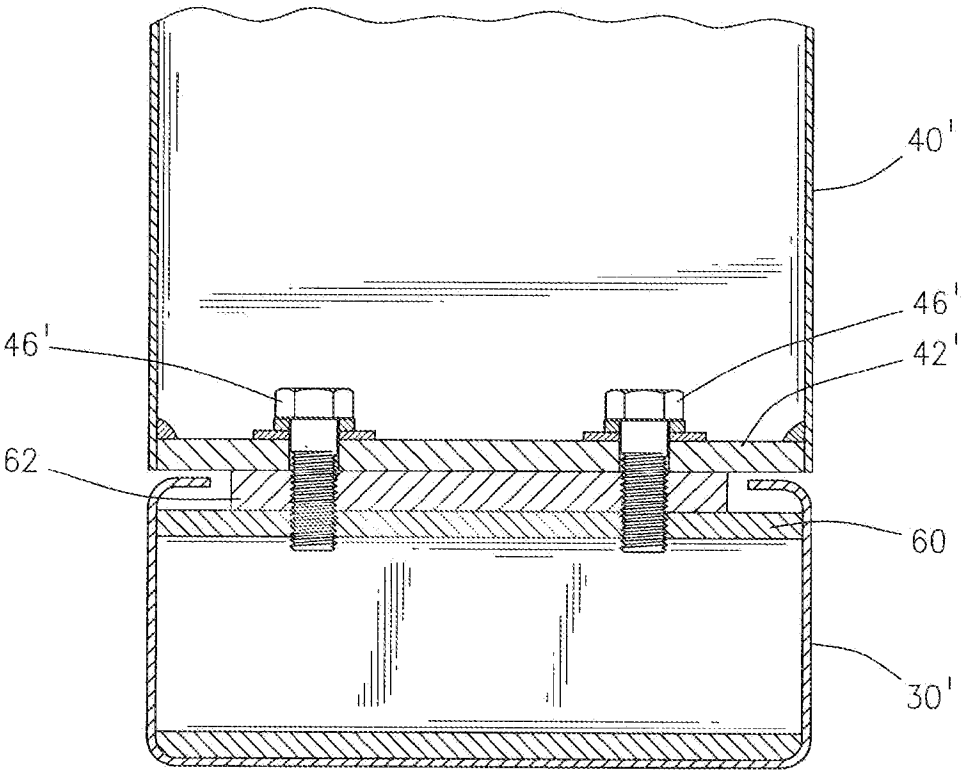
FIG. 10 is a sectional view of an alternate connection joint for use in the overhead door frame apparatus of the present invention.

FIG. 10 illustrates a sectional view of an alternate connection joint which may be used for construction of an overhead door frame apparatus. A C-channel member 30' is connected and joined to an adjacent C-channel number 40'. A metal tube 60 is welded within the C-channel member 30'. A spacer plate 62 is welded or otherwise secured to an outside of the tube 60.

A flat metal plate 42 is welded to the end of the C-channel 40'. A pair of openings is provided through the end plate 42.

A pair of threaded openings is provided through the spacer plate 62 and the metal tube 60. Accordingly, a pair of threaded bolts 46' is inserted through the end plate 42 and is threadably received in the spacer plate 62 and metal tube 60.

In order to construct and assemble the overhead door frame apparatus 10 of the present invention, the plurality of the first elongated structural C-channel members 30 are assembled with a tube secured within perpendicular to the C-channel member on a flat spacer plate attached thereto. Likewise, a plurality of adjacent C-channel members 40 are constructed with each of the adjacent C-channel members having a closed end. The various C-channel members and fasteners are shipped to a work site for installation of the overhead door. Once on-site, the first C-channel members are connected to the adjacent members with fasteners as described herein to construct an overhead door. Thereafter, an outer material face is added to the frame. Finally, the overhead door is installed on a track with a lift mechanism.

Whereas, the present invention has been described in relation to the drawings attached hereto, it should be understood that other and further modifications, apart from those shown or suggested herein, may be made within the spirit and scope of this invention.

What is claimed is:

1. An overhead door frame apparatus which comprises:

a plurality of elongated structural C-channel members, wherein said plurality of elongated structural C-channel members includes a plurality of first elongated structural C-channel members horizontally aligned and a plurality of adjacent C-channel members perpendicular to said plurality of first elongated structural C-channel members, at least one of the plurality of first elongated structural C-channel members having a tube residing and secured within and perpendicular to said at least one of the plurality of first elongated structural C-channel member and having a spacer attached to an outside of the tube, and at least one of said plurality of adjacent C-channel members having a closed end;

at least one fastener passing through said spacer and said tube of said at least one of the plurality of first elongated structural C-channel member and through said closed end of said at least one adjacent C-channel member;

such that said plurality of first elongated structural C-channel members, said plurality of adjacent C-channel members, and said at least one fastener together form a single-piece overhead door.

2. The overhead door frame apparatus as set forth in claim 1 wherein said spacer is a flat spacer plate.

3. The overhead door frame apparatus as set forth in claim 2 wherein said flat spacer plate is welded to said outside of said tube.

4. The overhead door frame apparatus as set forth in claim 1 wherein said fastener includes a threaded nut welded to said tube and includes a threaded bolt passing through said closed end and through said spacer and said tube.

5. The overhead door frame apparatus as set forth in claim 1 wherein said fastener includes a threaded opening in said spacer and in said tube and includes a threaded bolt received in said threaded opening.

6. The overhead door frame apparatus as set forth in claim 1 including a further first elongated structural C-channel member of said plurality of first elongated structural C-channel members having a closed end is joined with said at least one adjacent C-channel member with at least one fastener.

7. The overhead door frame apparatus as set forth in claim 1 wherein said closed end of said at least one adjacent C-channel member includes a flat metal end plate welded to an end of said at least one adjacent C-channel member.

8. The overhead door frame apparatus as set forth in claim 1 wherein each of said plurality of structural C-channel members includes an elongated channel having a base, two legs extending vertically and a radial lip extending from each leg.

9. The overhead door frame apparatus as set forth in claim 1 wherein said tube is a metal tube, having a square or rectangular cross-section and having a length slightly less than the width of said at least one of said plurality of first elongated structural C-channel member.

10. The overhead door frame apparatus as set forth in claim 1 including at least one further adjacent C-channel member having a closed end and at least one fastener passing through said tube and said at least one of said plurality of first elongated structural C-channel member.

11. An overhead door frame apparatus which comprises:

a plurality of elongated structural C-channel members, wherein said plurality of elongated structural C-channel members includes a plurality of first elongated structural C-channel members horizontally aligned and a plurality of adjacent C-channel members perpendicular to said plurality of first elongated structural C-channel members, at least one of the plurality of first elongated structural C-channel members having a tube secured within and perpendicular to said at least one of the plurality of first elongated structural C-channel member and having a spacer attached to an outside of the tube, at least one of said plurality of adjacent C-channel members having a closed end;

at least one fastener passing through said spacer and said tube of said at least one of the plurality of first elongated structural C-channel member and through said closed end of said at least one adjacent C-channel member; and at least one further adjacent C-channel member having a closed end and at least one fastener passing through said tube and said at least one of said plurality of first elongated structural C-channel member;

such that said plurality of first elongated structural C-channel members, said plurality of adjacent C-channel members, and said at least one fastener assemble a single-piece overhead door on location.

* * * * *